US005139141A

United States Patent [19]

Dickie

[11] Patent Number: 5,139,141

[45] Date of Patent: Aug. 18, 1992

[54] EXTENSION CORD RETAIL SLEEVE

[75] Inventor: Robert G. Dickie, Newmarket, Canada

[73] Assignee: Paige Manufacturing Corp., Newport Beach, Calif.

[21] Appl. No.: 803,859

[22] Filed: Dec. 9, 1991

[51] Int. Cl.[5] ..... B65D 73/00

[52] U.S. Cl. ..... 206/329; 206/328

[58] Field of Search ..... 206/329, 331, 328

[56] References Cited

U.S. PATENT DOCUMENTS 3,008,571 11/1961 Bond ..... 206/331

3,310,623 3/1967 Vaughan ..... 206/328 X 4,570,792 2/1986 Conway ..... 206/328 X 4,979,614 12/1990 Ruhaut ..... 206/328

*Primary Examiner*—William I. Price

[57] ABSTRACT

An electric extension cord retail sleeve formed from flat paper or cardboard stock which is folded into a rectangular sleeve into which a looped extension cord is inserted. An opening in one broader panel of the sleeve receives the extension cord socket oriented to receive the prongs of the extension cord plug, inserted through the opposite broader panel of the sleeve, thereby holding the extension cord and sleeve in a convenient retail assemblage.

2 Claims, 2 Drawing Sheets

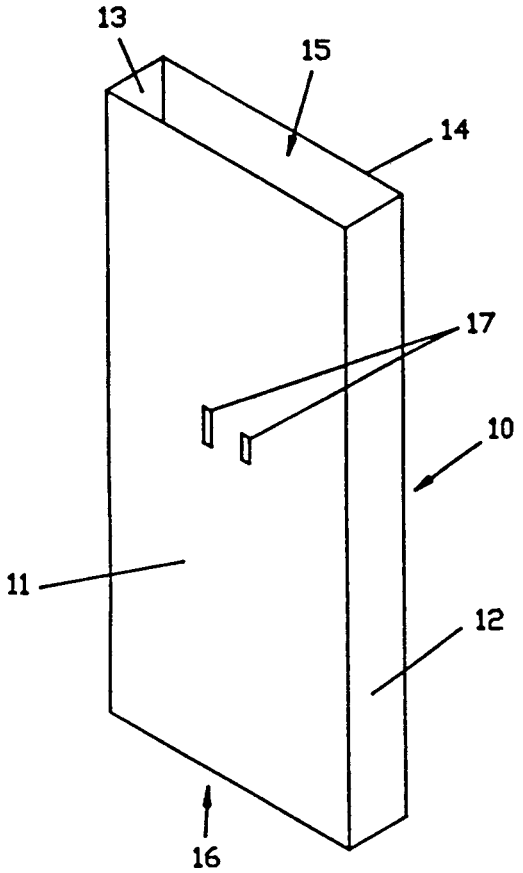
FIG. 1
FIG. 2
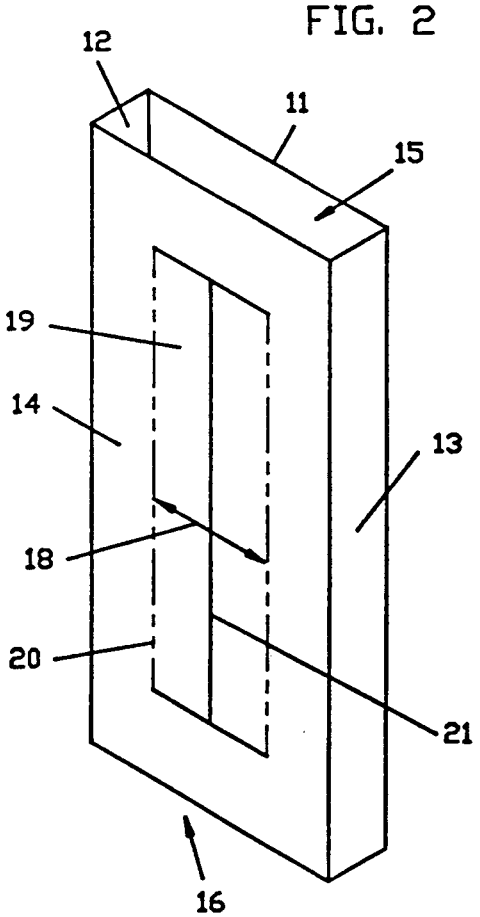

EXTENSION CORD RETAIL SLEEVE

TECHNICAL FIELD

This invention relates to packaging techniques and, more particularly, to efficient packaging of electrical extension cords or the like.

BACKGROUND OF THE INVENTION

It has become common to package retail extension cords by simple bands surrounding the center of the coiled extension cord. Such bands hold the coiled cord together and provide a convenient surface for identifying the source of these goods, the price and other promotional material. The plug and socket at the ends of the cord are allowed to extend out of the band, thus permitting such plugs and sockets to become entangled in the loops or coils of other extension cords, making the cords difficult to separate. Furthermore, the loops of the extension cord often escape from the band during handling, causing further snagging or even separation from the band. An alternative is a bubble pack in which the cord is fully encased in a plastic bubble attached to a cardboard sheet. Such bubble packs, however, are expensive, requiring large bubble forming machines.

The packaging and display materials which are required to bring extension cords to the retail marketplace add significantly to the cost of such cords. Not only must the cost of the materials be added to the cost, but also the cost of the labor required to package and display the extension cords in the retail outlet must be included.

SUMMARY OF THE INVENTION

In accordance with the illustrative embodiment of the present invention, a single, convenient sleeve is provided for electrical extension cords which captures the extension cord in a simple, inexpensive package and also permits the plug and socket to be joined together and hence not free to snag the loops of other cords. More particularly, the cord is formed into a loop with the female socket placed in the center of the loop. A rectangular sleeve of cardboard or paper is slipped over the looped cord and fold down cutouts on the rear face of the sleeve are folded toward the interior of the tube to form two rectangular channels along each edge of the sleeve. The opposing sides of the looped extension cord are captured in the two rectangular channels while the socket is captured in the center between the two channels, with electrical plug receiving slots facing the front face of the sleeve. Two prong-shaped cutouts in the front face of the sleeve allow the prongs on the plug of the extension cord to be pushed through the front face of the sleeve into the slots of the socket on the other side of the front face.

One advantage of the extension cord retail sleeve of the present invention is the fact that, once assembled, the plug tends to retain its integrity through handling procedures which might dislodge other extension cords from their packaging devices. Moreover, the flat surfaces of the sleeve are ideal places for printing promotional material, instructions, ratings and other desirable materials.

BRIEF DESCRIPTION OF THE DRAWINGS

A complete understanding of the present invention may be gained by considering the following detailed description in conjunction with the accompanying drawings, in which:

FIG. 1 shows a perspective front view of a extension cord retail sleeve in accordance with the present invention;

FIG. 2 shows a perspective rear view of the same extension cord retail sleeve shown in FIG 1;

To facilitate reader understanding, identical reference numerals are used to designate elements common to the figures.

DETAILED DESCRIPTION

Figure 3:
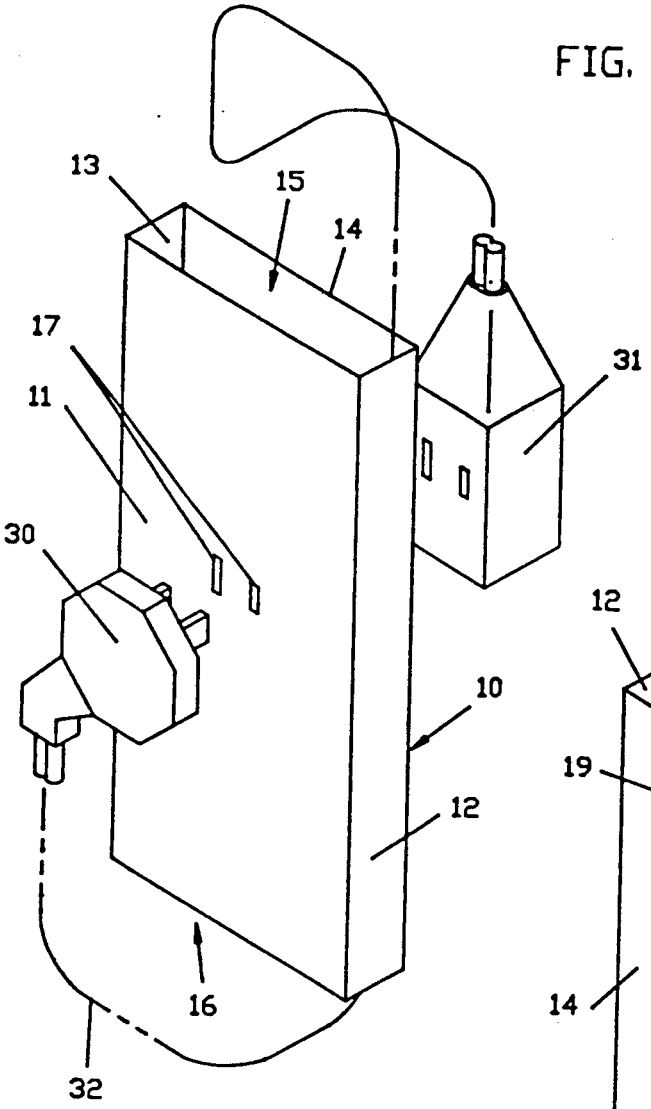
FIG. 3 shows a perspective front view of the extension cord retail sleeve shown in FIG. 1 showing the socket and plug of the extension cord to be packaged by the retail sleeve.

Referring more particularly to FIG. 1, there is shown a perspective front view of an electric extension cord retail sleeve comprising a rectangularly shaped paper or cardboard sleeve 10 having a broad front panel 11, two narrow side panels 12 and 13 and a rear panel 14. The ends 15 and 16 of sleeve 10 are open. A pair of slots 17 in front panel 11 are sized and spaced to receive the prongs or contacts of a standard 110 volt household electric plug.

In FIG. 2 there is shown a perspective rear view of the retail sleeve of FIG. 1. As can be seen in FIG. 2, the rear panel 14 of the sleeve has a rectangular opening 18, shown by arrow 18, therein. The interior sides of opening 18, one of which is show in FIG. 2 as flap 19, are parallel to side panels 12 and 13, and comprise paper on cardboard. Interior flap 19 is preferably formed by folding the material which was in opening 18 towards front panel 11 along fold line 20.

Figure 4:
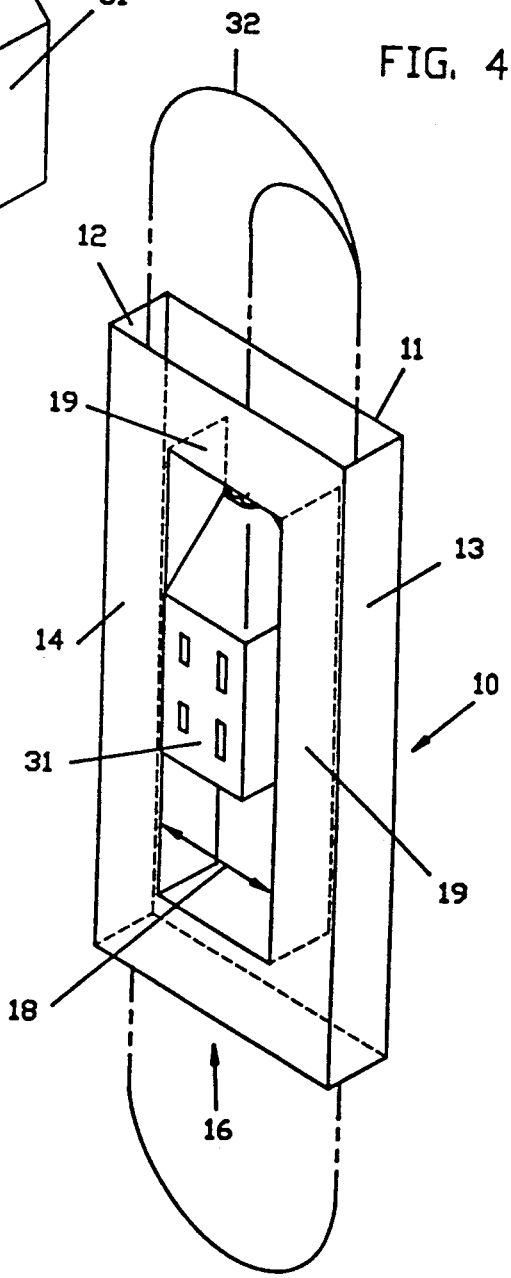
FIG. 4 shows a perspective rear view of the extension cord retail sleeve of FIG 3 showing the placement of the socket in a central cavity in the sleeve.

The retail sleeve shown in FIGS. 1 and 2 is used, as shown in FIGS. 3 and 4, to capture an electrical extension cord in a package suitable for retail sales. As shown in FIG. 3, an extension cord having a plug 30 attached to one end and a socket 31 attached to the other end. The electric wires of the cord are shown symbolically by dashed line 32 which is shown as folded or looped inside of sleeve 10. As can be seen in FIG. 4, the socket 31 is placed in the opening 18 with contact clots facing the front panel 11 and registering with the slots 17 in front panel 11.

In use, the extension cord is looped and slid into sleeve 10, the two flaps corresponding to flap 19 being left unfolded in the plane of rear panel 14. With the extension cord in position inside of sleeve 10, flaps 19 are folded inward to position 21 to capture to looped electrical wires in a channel between flaps 19 and side panels 12 and 13, respectively, of sleeve 10. The socket 31 can then be placed in opening 18 with electric prong or blade openings facing front panel 11. When the socket 31 is fitted into the opening 18, socket 31 serves to hold the flaps 19 in position, thus securing the loops of the extension cord in the channels between flaps 19 and the end panels 12 and 13. Extension cord sockets normally have multiple sets of female connector openings. Such openings are shown in FIG. 4 on the rear surface of socket 31. Such openings are also located on the opposite front face of socket 31, not visible in FIG. 4.

Once the socket 31 is in place in opening 18 and registered with slots 17, the plug 30 can be inserted through slots 17 into the openings in socket 31. Although any style of electric plug can be used in the arrangements of the present invention, it is particularly advantageous for the flat profile electric plug disclosed in applicant's U.S. Pat. No. 4,927,376, granted May 22, 1990.

As is normal for such electrical plugs and sockets, a significant amount of frictional retention force is exerted between the plug blades and the socket openings to retain the blades in the socket until forcibly removed. This force tends to hold plug 30 in socket 31 and thereby hold the extension cord in the sleeve 10. The assemblage thus formed is ideally suitable for retail sales of the extension cord and for storage and distribution of the assemblages. Sleeve 10 not only serves to keep the assemblage together, but also serves as a convenient surface for printing promotional materials, prices, trademarks, instructions, ratings, and other useful information. Moreover, sleeves like sleeve 10 can be manufactured, shipped and stored in flat packets, conserving space, and opened up into a sleeve only when assembled with the extension cord itself.

It should also be clear to those skilled in the art that further embodiments of the present invention may be made by those skilled in the art without departing from the teachings of the present invention.

What is claimed is:

1. A retail sleeve for an electric extension cord comprising a rectangular tube having two narrow side panels, two broader face panels and two open ends for receiving a looped extension cord, an opening in one of said broader face panels for receiving the socket of said electric extension cord, and at least two slots in the other broader face panel for inserting the plug of said extension cord through said other broader face panel into said socket in said opening.

2. The retail sleeve according to claim 1 wherein said opening has side panels formed by folding the material from said opening towards said other broader face, thereby to form a cord-containing channel between said opening side panels and said sleeve side panels.

* * * * *